US008327782B2

(12) United States Patent
Tseng et al.

(10) Patent No.: US 8,327,782 B2
(45) Date of Patent: Dec. 11, 2012

(54) DEVICE FOR DRIVING MOVEMENT OF A PIECE OF CLOTH TO BE EMBROIDERED

(75) Inventors: Shui-Chun Tseng, Taichung Hsien (TW); Jia-Hui You, Taichung Hsien (TW); Rafale Liu, Taichung Hsien (TW); Seeven Chou, Taichung Hsien (TW)

(73) Assignee: Zeng Hsing Industrial Co., Ltd., Taiping (TW)

( * ) Notice: Subject to any disclaimer, the term of this patent is extended or adjusted under 35 U.S.C. 154(b) by 212 days.

(21) Appl. No.: 12/795,658

(22) Filed: Jun. 8, 2010

(65) Prior Publication Data

US 2011/0297062 A1 Dec. 8, 2011

(51) Int. Cl.
*D05C 7/04* (2006.01)

(52) U.S. Cl. ..... 112/103

(58) Field of Classification Search ..... 112/103, 112/104, 102, 102.5, 118, 119, 475.04, 475.18, 112/475.19
See application file for complete search history.

(56) References Cited

U.S. PATENT DOCUMENTS

| | | | | |
|---|---|---|---|---|
| 5,311,439 | A * | 5/1994 | Hayakawa et al. | 700/138 |
| 5,983,816 | A * | 11/1999 | Tomita | 112/102.5 |
| 6,820,565 | B1 * | 11/2004 | Kawaguchi et al. | 112/102.5 |
| 7,140,312 | B2 * | 11/2006 | Yamada | 112/470.05 |
| 7,168,378 | B2 * | 1/2007 | Fukao | 112/103 |

* cited by examiner

*Primary Examiner* — Tejash Patel
(74) *Attorney, Agent, or Firm* — The Mueller Law Office, PC

(57) ABSTRACT

A device for driving movement of a piece of cloth to be embroidered includes a driving unit for driving a mounting seat to move relative to a base unit. A cloth-holding frame device holds tensionally the piece of cloth between inner and outer frames, and includes an identification module mounted to a connecting block of the outer frame that is mounted detachably to mounting seat for generating an identification output corresponding to an embroidery area defined in the cloth-holding frame device. When the connecting block is connected to the mounting seat, the identification module is coupled to a control unit via a connecting port of the mounting seat. The control unit controls the driving unit based on the identification output from the identification module so that embroidery operation is performed on the piece of cloth disposed within the embroidery area in the cloth-holding frame device.

5 Claims, 5 Drawing Sheets

DEVICE FOR DRIVING MOVEMENT OF A PIECE OF CLOTH TO BE EMBROIDERED

BACKGROUND OF THE INVENTION

1. Field of the Invention

The invention relates to a driving device, and more particularly to a driving device for an embroidering machine.

2. Description of the Related Art

In a conventional embroidering machine, there are provided a plurality of cloth-holding frame units with different sizes for different embroidery patterns. In use, a selected cloth-holding frame unit is first mounted to the embroidering machine. Then, an embroidery area matching the selected cloth-holding frame unit is selected manually for the conventional embroidering machine.

However, the selected embroidery area may not match the selected cloth-holding frame due to a manual operation error, thereby resulting in an incorrect embroidery pattern. Furthermore, when the selected cloth-holding frame unit is configured with an embroidery area smaller than the selected embroidery area for the conventional embroidery machine, damage to a stitching unit of the conventional embroidering machine may occur.

SUMMARY OF THE INVENTION

Therefore, the object of the present invention is to provide a device for driving movement of a piece of cloth to be embroidered that can automatically judge a parameter of an embroidery area.

According to the present invention, there is provided a device for driving movement of a piece of cloth to be embroidered. The device comprises:

a base unit;

amounting seat mounted movably on the base unit and having a connecting port;

a driving unit disposed on the base unit for driving the mounting seat to move relative to the base unit;

a cloth-holding frame device adapted for holding the piece of cloth thereon, and mounted detachably to the mounting seat, the cloth-holding frame device including

- an outer frame having a connecting block connected detachably to the mounting seat,
- a looped inner frame disposed on and surrounded by the outer frame, and cooperating with the outer frame to define an embroidery area therein,
- a lock bolt for locking the outer frame on the looped inner frame such that the piece of cloth is held tensionally between the looped inner frame and the outer frame, and
- an identification module mounted to the connecting block of the outer frame for generating an identification output corresponding to the embroidering area, the identification module being connected electrically to the connecting port of the mounting seat when the connecting block of the outer frame is connected to the mounting seat such that the identification output from the identification module is outputted to the connecting port of the mounting seat; and a control unit coupled to the connecting port of the mounting seat and the driving unit, receiving the identification output from the identification module through the connecting port of the mounting seat when the connecting block of the outer frame is connected to the mounting seat, and operable to control the driving unit based on the identification output received thereby so that embroidery operation is performed on the piece of cloth held on the cloth-holding frame device and disposed within the embroidery area in the cloth-holding frame device.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
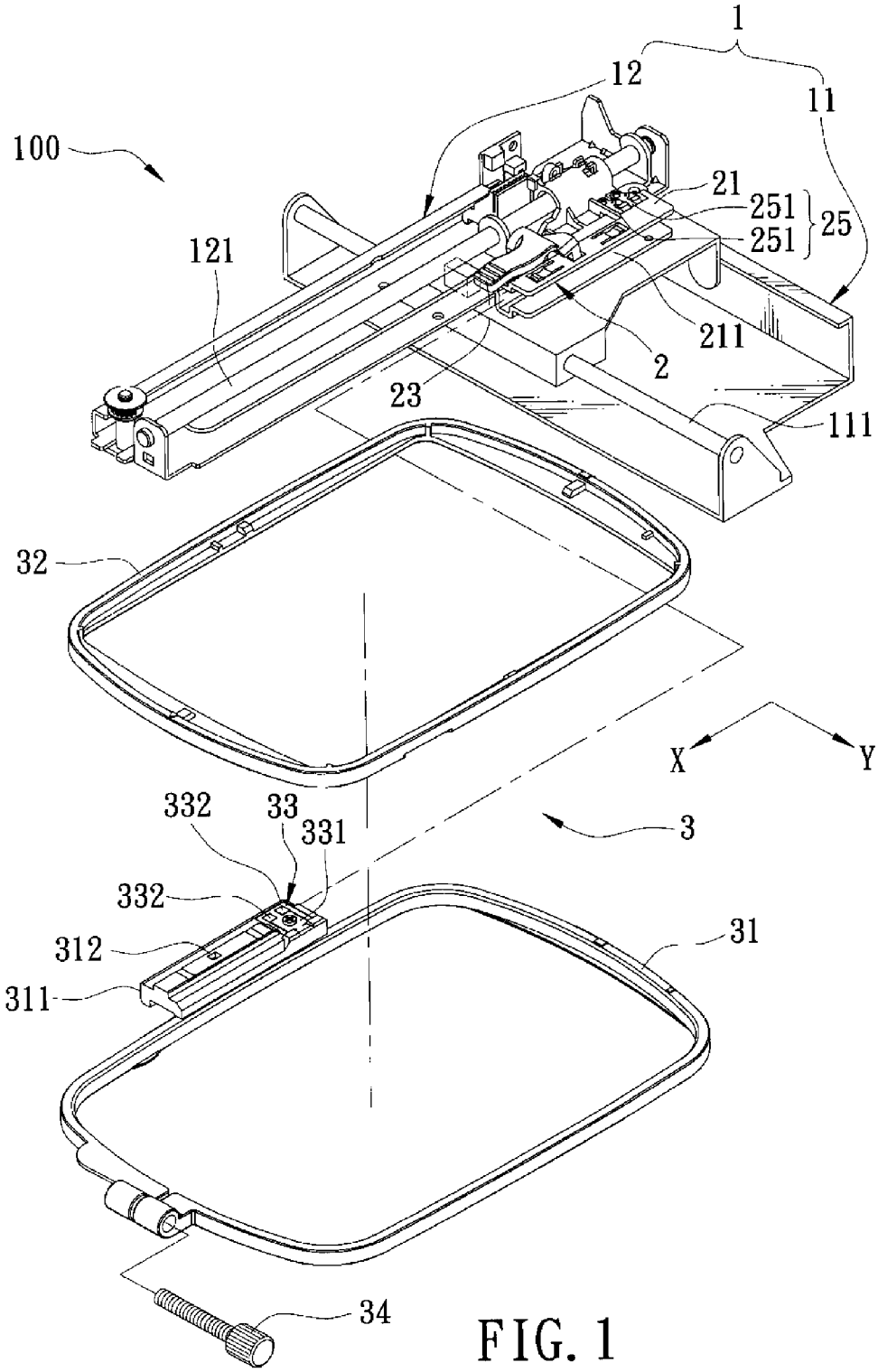
FIG. 1 is a partly exploded, fragmentary perspective view showing the preferred embodiment of a device for driving movement of a piece of cloth according to the present invention.
Figure 2:
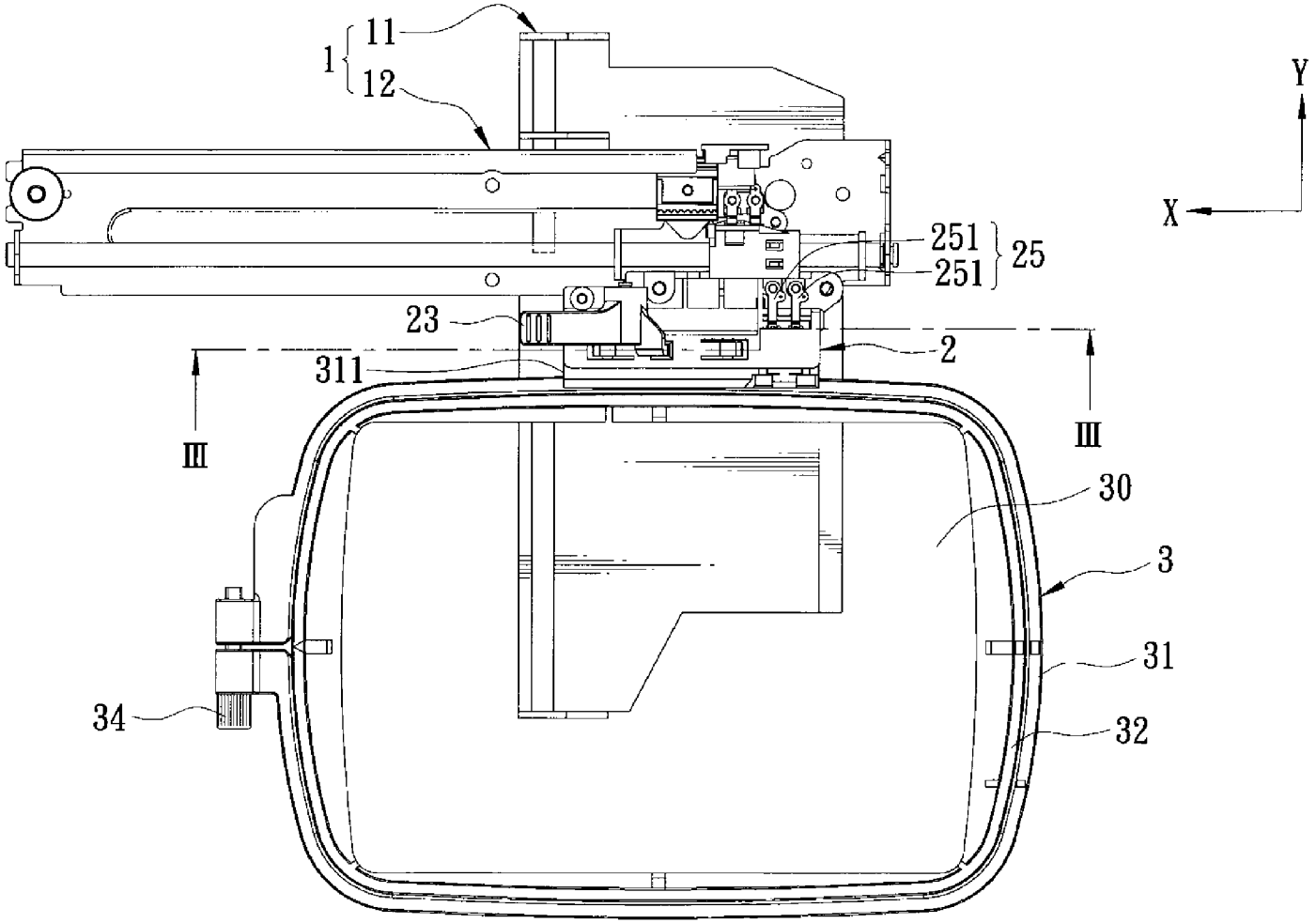
FIG. 2 is a fragmentary schematic top view showing the preferred embodiment.
Figure 4:
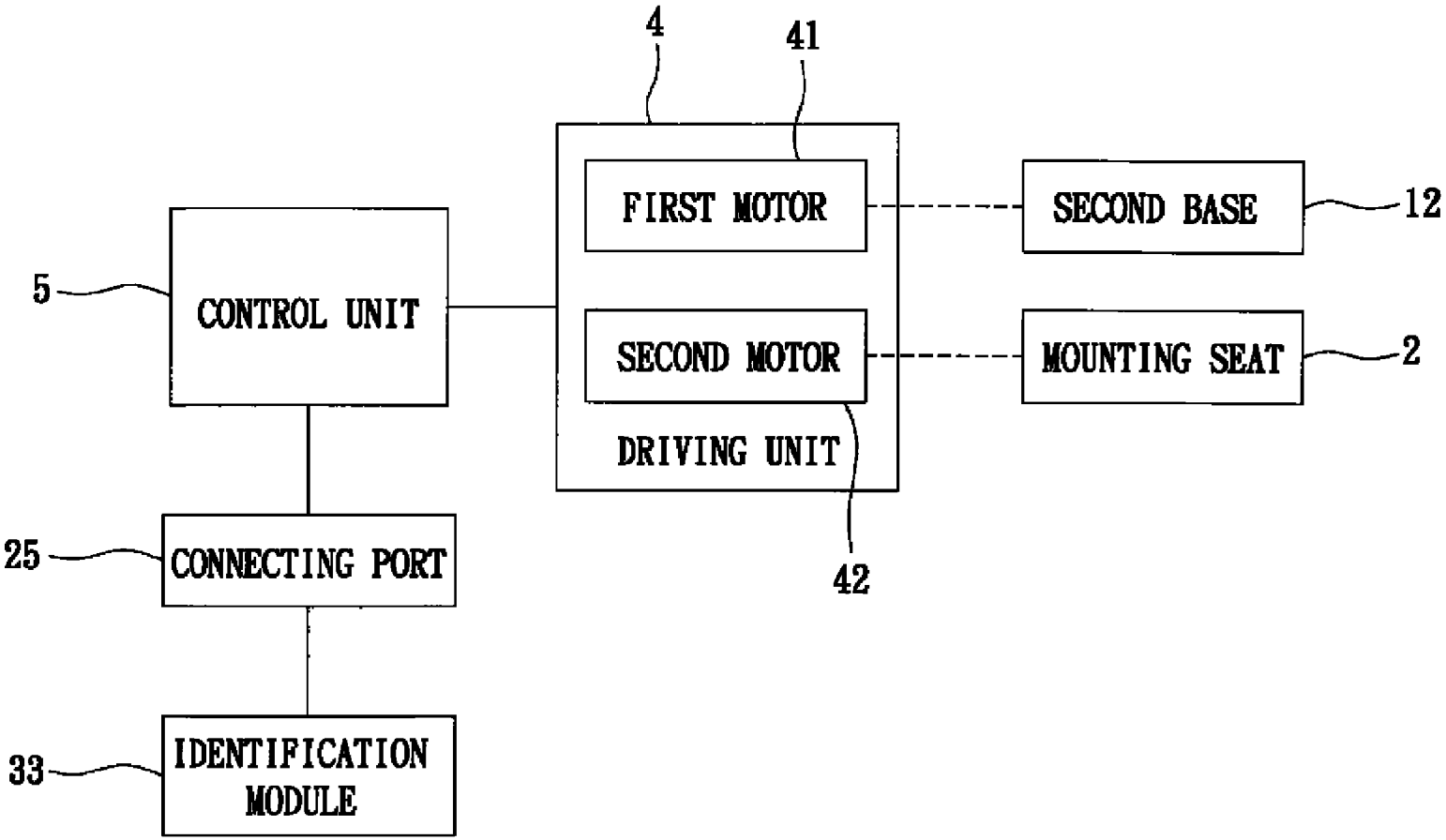
FIG. 4 is a schematic circuit block diagram illustrating the preferred embodiment.

Referring to FIGS. 1, 2 and 4, the preferred embodiment of a device 100 for driving movement of a piece of cloth (not shown) to be embroidered according to the present invention is shown to include a base unit 1, a mounting seat 2, a driving unit 4, a cloth-holding frame device 3, and a control unit 5. In this embodiment, the device 100 is adapted to be embodied in an embroidering machine (not shown).

In this embodiment, the base unit 1 includes a stationary first base 11, and a movable second base 12 mounted movably on the first base 11 and guided by a guiding rod 111 of the first base 11 extending in a first direction (Y) so that the second base 12 is movable relative to the first base 11 in the first direction (Y). In addition, the second base 12 has a guiding rod 121 extending in a second direction (X) that is transverse to the first direction (Y).

Figure 3:
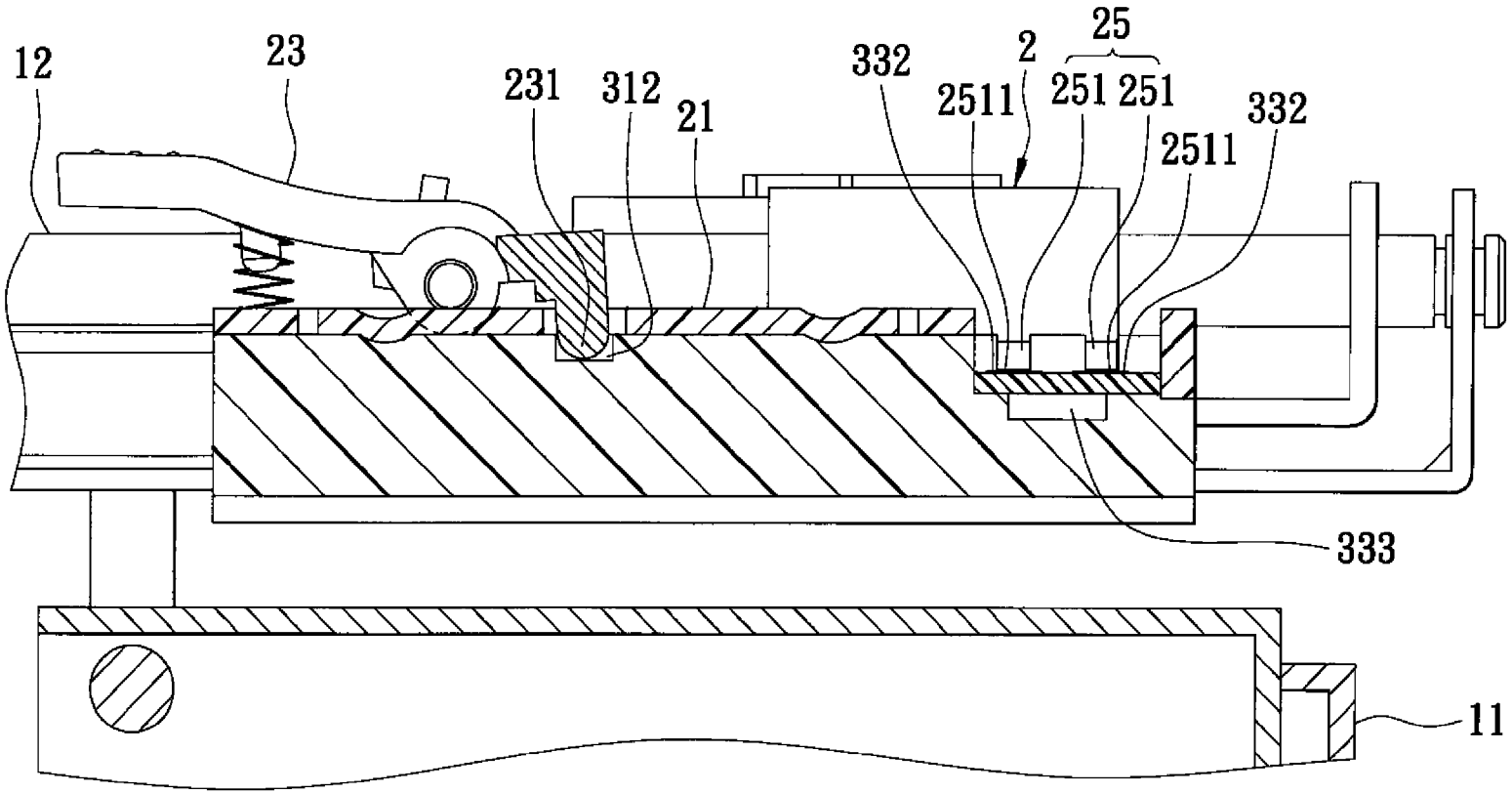
FIG. 3 is a schematic sectional view of the preferred embodiment taken along line III-III in FIG. 2.

The mounting seat 12 is mounted movably on the base unit 1, and has a connecting port 25. In this embodiment, the mounting seat 2 further has a main body 21 and a spring-loaded engaging piece 23. The main body 21 is connected movably to and is guided by the guiding rod 121 of the second base 12 of the base unit 1 such that the mounting seat 12 is movable relative to the second base in the second direction (X). The main body 21 is formed with an insertion groove 211 that extends in the second direction (X). The spring-loaded engaging piece 23 is disposed pivotally on the main body 21, and has an engaging end portion 231 that extends into the insertion groove 211 in the main body 21, as shown in FIG. 3. In this embodiment, the connecting port 25 has two conductive pieces 251 disposed on the main body 21. Each conductive piece 251 has a contacting end portion 2511 that extends into the insertion groove 211 in the main body 21, as shown in FIG. 3.

The cloth-holding frame device 3 is adapted for holding the piece of cloth thereon, and is mounted detachably to the mounting seat 2. The cloth-holding frame device 3 includes an outer frame 31, a looped inner frame 32, a lock bolt 34, and an identification module 33.

The outer frame 31 has a connecting block 311 connected detachably to the mounting seat 2. In this embodiment, the insertion groove 211 in the main body 21 of the mounting seat 2 permits insertion of the connecting block 311 thereinto. The connecting block 311 is formed with an engaging recess 312 that engages releasably the engaging end portion 231 of the spring-loaded engaging piece 23 when the connecting block 311 is inserted into the insertion groove 211 in the main body 21 of the mounting seat 2, thereby retaining the connecting block 311 in the insertion groove 211 in the main body 21.

The looped inner frame 32 is disposed on and is surrounded by the outer frame 31, and cooperates with the outer frame 31 to define an embroidery area 30 therein, as shown in FIG. 2.

The lock bolt 34 locks the outer frame 31 on the looped inner frame 32 such that the piece of cloth is held tensionally between the looped inner frame 32 and the outer frame 31.

The identification module 33 is mounted to the connecting block 311 of the outer frame 31 for generating an identification output corresponding to the embroidery area 30. In this embodiment, the identification module 33 includes a circuit board 331 disposed on the connecting block 311 of the outer frame 31 and formed with two conductive contacts 332, and an electronic element 333 mounted on the circuit board 331, disposed in the connecting block 311 of the outer frame 31 and coupled to the conductive contacts 332 for generating the identification output. When the connecting block 311 of the outer frame 31 is inserted into the insertion groove 211 in the main body 21 of the mounting seat 2, the contacting end portion 2511 of each conductive piece 251 of the connecting port 25 is in electrical contact with a corresponding conductive contact 332, as shown in FIG. 3. In this embodiment, the electronic element 333 includes a resistor. In this case, the identification output indicates the resistance of the resistor. Alternatively, the electronic element 333 includes a capacitor. In this case, the identification output indicates the capacitance of the capacitor.

Figure 5:
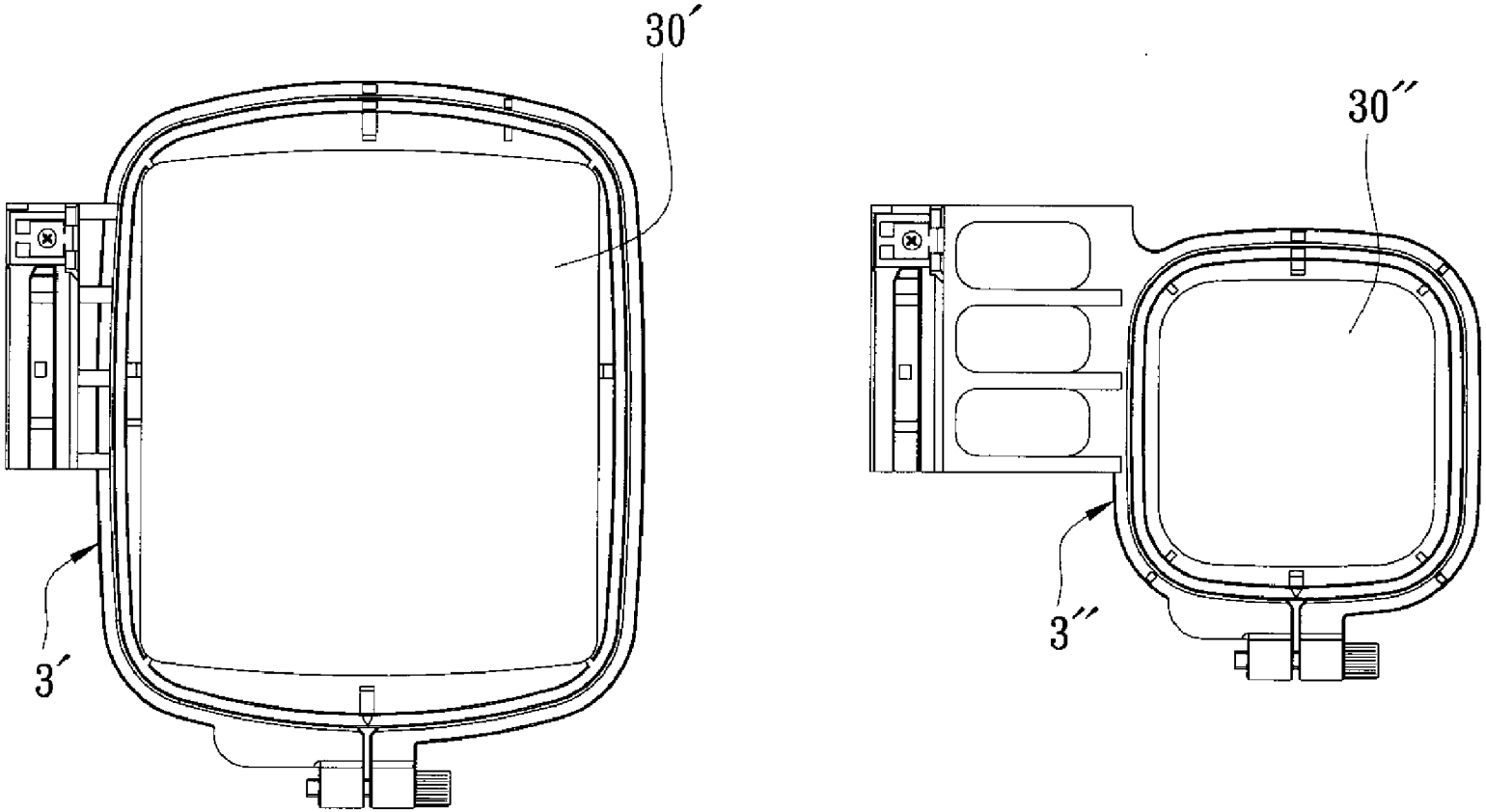
FIG. 5 is a schematic top view showing variations of a cloth-holding frame device of the preferred embodiment.

FIG. 5 illustrates variations of the cloth-holding frame device 3', 3" each configured with a respective embroidery area 30', 30".

The driving unit 4 is disposed on the base unit 1 for driving the mounting seat 2 to move relative to the base unit 1. In this embodiment, as shown in FIG. 4, the driving unit 4 includes a first motor 41 for driving the second base 12 of the base unit 1 to move relative to the first base 11 of the base unit 1 in the first direction (Y), and a second motor 42 for driving the mounting seat 2 to move relative to the second base 12 of the base unit 2 in the second direction (X).

The control unit 5 is coupled to the connecting port 25 of the mounting seat 2 and the driving unit 4, and receives the identification output from the identification module 33 through the connecting port 25 of the mounting seat 2 when the connecting block 311 of the outer frame 31 is connected to the mounting seat 2. The control unit 4 is operable to control the driving unit 4 based on the identification output received thereby so that embroidery operation of a stitching unit of the embroidering machine (not shown) is performed on the piece of cloth held on the cloth-holding frame device 3 and disposed within the embroidery area 30 in the cloth-holding frame device 3

In sum, when the cloth-holding frame device 3 is connected to the mounting seat 2, the control unit 5 can automatically judge a parameter of the embroidery area 30 in the cloth-holding frame device 3 based on the identification output from the identification module 33 of the cloth-holding frame device 3. Thus, the control unit 5 controls the driving unit 4 based on the identification output such that the device 100 of the present invention can ensure embroidery operation for the piece of cloth performed within the embroidery area 30.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A device for driving movement of a piece of cloth to be embroidered, comprising:

a base unit;

a mounting seat mounted movably on said base unit and having a connecting port;

a driving unit disposed on said base unit for driving said mounting seat to move relative to said base unit;

a cloth-holding frame device adapted for holding the piece of cloth thereon, and mounted detachably to said mounting seat, said cloth-holding frame device including an outer frame having a connecting block connected detachably to said mounting seat, a looped inner frame disposed on and surrounded by said outer frame, and cooperating with said outer frame to define an embroidery area therein, a lock bolt for locking said outer frame on said looped inner frame such that the piece of cloth is held tensionally between said looped inner frame and said outer frame, and an identification module mounted to the connecting block of said outer frame for generating an identification output corresponding to said embroidering area, said identification module being connected electrically to said connecting port of said mounting seat when said connecting block of said outer frame is connected to said mounting seat such that the identification output from said identification module is outputted to said connecting port of said mounting seat; and a control unit coupled to said connecting port of said mounting seat and said driving unit, receiving the identification output from said identification module through said connecting port of said mounting seat when said connecting block of said outer frame of said cloth-holding frame device is connected to said mounting seat, and operable to control said driving unit based on the identification output received thereby so that embroidery operation is performed on the piece of cloth held on said cloth-holding frame device and disposed within said embroidery area in said cloth-holding frame device;

wherein said base unit includes a stationary first base and a movable second base mounted movably on said first base so that said second base is movable relative to said first base in a first direction;

wherein said connecting block of said outer frame of said cloth-holding frame device is formed with an engaging recess, and said mounting seat further having:

i) a main body connected movably to said second base of said base unit and formed with an insertion groove that extends in a second direction and that permits insertion of said connecting block of said outer frame of said cloth-holding frame device thereinto, and ii) a spring-loaded engaging piece disposed pivotally on said main body and having an engaging end portion that extends into said insertion groove in said main body and that engages releasably said engaging recess in said connecting block of said outer frame of said cloth-holding frame device when said connecting block of said outer frame is inserted into said insertion groove in said main body, thereby retaining said connecting block of said outer frame in said insertion groove in said main body.

2. The device as claimed in claim 1, wherein:

said mounting seat is mounted movably on said second base of said base unit, and is movable relative to said second base of said base unit in the second direction that is transverse to the first direction; and said driving unit includes a first motor for driving said second base to move relative to said first base of said base unit in the first direction, and a second motor for driving said mounting seat to move relative to said second base of said base unit in the second direction.

3. The device as claimed in claim 1, wherein:

said identification module of said cloth-holding frame device includes a circuit board disposed on said connecting block of said outer frame and formed with two conductive contacts, and an electronic element mounted on said circuit board, disposed in said connecting block of said outer frame and coupled to said conductive contacts on said circuit board for generating the identification output; and said connecting port of said mounting seat has two conductive pieces disposed on said main body of said mounting seat and coupled to said control unit, each of said conductive pieces having a contacting end portion that extends into said insertion groove in said main body of said mounting seat and that is in electrical contact with a corresponding one of said conductive contacts on said circuit board of said identification module when said connecting block of said outer frame is inserted into said insertion groove in said main body of said mounting seat.

4. The device as claimed in claim 3, wherein said electronic element of said identification module includes a resistor, said identification output indicating the resistance of said resistor.

5. The device as claimed in claim 3, wherein said electronic element of said identification module includes a capacitor, said identification output indicating the capacitance of said capacitor.

* * * * *